US005492615A

United States Patent [19]

Houman

[11] Patent Number: 5,492,615

[45] Date of Patent: Feb. 20, 1996

[54] CYCLODEXTRIN STABILIZATION OF ORGANIC METAL FINISHING ADDITIVES IN AQUEOUS METAL TREATING BATHS

[75] Inventor: John Houman, Oyster Bay, N.Y.

[73] Assignee: LeaRonal Inc., Freeport, N.Y.

[21] Appl. No.: 343,198

[22] Filed: Nov. 22, 1994

[51] Int. Cl.[6] ..... C25D 11/08; C25D 3/00; C23C 16/00; C23C 18/00

[52] U.S. Cl. ..... 205/238; 106/105; 106/112; 106/118; 106/122; 106/125; 205/244; 205/253; 205/259; 205/261; 205/278; 205/296; 205/311

[58] Field of Search ..... 106/1.05, 1.12, 106/1.13, 1.16, 1.17, 1.18, 1.22, 1.23, 1.25, 1.26, 1.27; 205/244, 253, 259, 278, 296, 302, 311

[56] References Cited

U.S. PATENT DOCUMENTS 3,459,731 8/1969 Gramera et al. ..... 260/209

FOREIGN PATENT DOCUMENTS 281891 12/1986 Japan .

OTHER PUBLICATIONS

Yonezawa, *Agric. Biol. Chem.* 45(2), 505–6 (1981). no month.

*Primary Examiner*—John Niebling
*Assistant Examiner*—Edna Wong
*Attorney, Agent, or Firm*—Krumholz & Mentlik Lerner, David, Littenberg

[57] ABSTRACT

A method for stabilizing organic metal finishing additives in aqueous metal treating baths by dissolving the organic metal finishing additive with a cyclodextrin and a common solvent therefor, so that an inclusion compound of the organic metal finishing additive in the cyclodextrin is formed, and then dissolving the inclusion compound in an aqueous metal treating bath. Aqueous metal treating baths having dissolved therein inclusion compounds of organic metal finishing additives in cyclodextrins are also described.

21 Claims, No Drawings

CYCLODEXTRIN STABILIZATION OF ORGANIC METAL FINISHING ADDITIVES IN AQUEOUS METAL TREATING BATHS

BACKGROUND OF THE INVENTION

The present invention relates to the stabilization of organic metal finishing additives in aqueous metal treating baths, and more particularly, to the stabilization of such organic additives by forming inclusion compounds thereof with cyclodextrins. The present invention also relates to aqueous metal treating baths in which inclusion compounds of organic metal finishing additives in cyclodextrins have been dissolved therein. The present invention provides a significant improvement in the solubility and stability of organic metal finishing additives in aqueous metal treating baths without detracting from the activity of the additive. Consequently, significantly less of the additive can be used in the treating bath to obtain the desired effect.

Organic metal finishing additives are materials that can improve the final result of many metal finishing processes. Metal finishing additives are generally used in electro or electroless plating processes to improve deposit properties such as brightness, hardness, ductility, solderability, density and other desirable characteristics. These finishing additives can be used in metal treating processes such as cleaning, pickling, etching, and the like, in order to improve the desired results obtained therewith.

In order to be effective, metal finishing additives should have good solubility in the process solvents used. They should be stable, non-volatile and long-lasting. The search for useful additives of this type has often led to organic chemical compounds which would otherwise be very useful in a metal finishing process; however, in many cases, they lack the solubility, stability or some other property, which therefore limits or negates their use.

In particular, the utility of a metal finishing additive depends upon the ability to control the additive concentration in the process solvent. This becomes problematic when the additive is unstable in the solvent, lacks solubility in the solvent, is volatile, or forms insoluble metal precipitates. At best, this problem is solved by using excess quantities of the additives to maintain an effective concentration as the additive precipitates, degrades or evaporates. At worst, the incompatibility of the process solvent may be so severe that the additive cannot be used at all.

For example, in acid copper plating solutions, copper deposits with improved brightness are obtained by adding small quantities of tetraethylthiuramidisulfide (TETD) to a conventional bright acid copper plating bath. Because TETD is insoluble in water, it must first be dissolved in methanol and then added to the plating bath as an alcoholic solution. The problem is that the additive does not remain in solution, and its beneficial effect is therefore lost as it quickly precipitates out of solution.

Flavanols are useful metal finishing additives for divalent acid tin plating baths. These compounds have a short life in the acid tin bath because they tend to form insoluble complexes with tin that results in a precipitation out of the solution. In addition, flavanols are poorly soluble in the acid tin bath, and must therefore be used at low concentrations. This poor solubility coupled with the tendency to precipitate with tin severely limits the use of flavanols in acid tin plating baths.

Acetaldehyde is another desirable additive for use in divalent acid tin plating baths. While acetaldehyde is water soluble, its bath concentration is difficult to control because of its great volatility at ambient and elevated temperatures.

Attempts to stabilize these various types of metal finishing additives in process solvents to date have at best prolonged the length of time for which an effective concentration of the additive may be maintained in the solvent. There remains a need for a means by which organic metal finishing additives may be stably incorporated into aqueous metal treating baths in a manner that provides effective concentrations with the addition of minimal quantities of the finishing additives.

SUMMARY OF THE INVENTION

It has now been discovered that cyclodextrins can be utilized to form water-soluble stable inclusion compounds with organic metal finishing additives. The formation of the inclusion compound is found to render water-insoluble additives water-soluble, unstable additives non-degrading, and volatile additives non-volatile. The inclusion compounds have also been found to prevent the formation of water-insoluble metal precipitates by additives that ordinarily complex with process bath metals to form same.

The cyclodextrin enhances the water-solubility, hydrolytic stability and non-volatility of organic materials and inhibits the formation of metal precipitates without inhibiting the activity of the metal finishing additives. This allows the use of lesser quantities of the additives to obtain the desired effect. Amounts equivalent to less than one-half of the conventional quantity of an additive may be employed to obtain the desired effect because the residence time of the material in the process solvent is significantly increased by formation of the cyclodextrin inclusion compound. While cyclodextrins are known to form water-soluble inclusion compounds with water-insoluble organic materials, the enhanced activity of the organic metal finishing additives in process solvents in addition to the hydrolytic stability and water solubility, is completely unexpected, as is the non-volatility and inhibition of metal precipitate formation.

Therefore, in accordance with the present invention, there is provided a method for stabilizing organic metal finishing additives in aqueous metal treating baths including the steps of:

dissolving the organic metal finishing additive with a cyclodextrin in a common solvent therefor, so that an inclusion compound of the organic finishing additive in the cyclodextrin is formed; and dissolving the inclusion compound in the aqueous metal treating bath.

The present invention thus provides the means by which organic metal finishing additives may be stably incorporated in aqueous metal treating baths. Therefore, the present invention also includes aqueous metal treating baths having dissolved therein an inclusion compound of an organic metal finishing additive in a cyclodextrin. This aspect of the present invention includes organic metal finishing additives that are poorly water-soluble, hydrolytically unstable, highly volatile or which form insoluble metal precipitates.

The cyclodextrin inclusion compounds thus improve the water-solubility of organic metal finishing additives, protect the additives from hydrolytic attack and inhibit the evaporation of volatile materials and the formation of water-insoluble metal complexes. Not only does this permit the use of materials that would otherwise lack utility, loss of the additives by hydrolytic degradation, evaporation, precipitation and the like is virtually eliminated. The quantity of additive employed may be significantly reduced, yet with an improvement in the metal finishing properties contributed by the additive. In other words, the efficiency and cost effectiveness of organic metal finishing additives are greatly increased by the incorporation of the additives into cyclodextrin inclusion compounds, providing a cost savings to metal finishing additive users with an improvement in, rather than a sacrifice of, metal finishing additive performance. Other features and advantages of the present invention will be more readily apparent from the detailed description of the preferred embodiment set forth below.

DETAILED DESCRIPTION OF THE PREFERRED EMBODIMENT

The present invention employs cyclodextrins as stabilizers for organic metal finishing additives for use in aqueous metal treating baths. In the present specification, the stabilizing function of the cyclodextrin refers to the improvement in water solubility, hydrolytic stability and non-volatility provided by the formation of the inclusion compound with the cyclodextrin, as well as the inhibition of metal precipitate formation. Dissolving the cyclodextrin in a common solvent such as water or a water-miscible solvent such as methanol or similar lower alkanols with an organic metal finishing additive results in the formation of a cyclodextrin inclusion compound that is not only readily soluble in aqueous metal treating baths without a loss in the activity of the finishing additive, but also protects the additive from hydrolytic attack, and inhibits the additive from evaporating or forming insoluble metal precipitates.

Cyclodextrin polyethers are described in U.S. Pat. No. 3,459,731 to Gramera. This patent discloses that cyclodextrins form a variety of crystalline inclusion compounds with many organic substances, particularly with organic liquids of low solubility in water. The cyclodextrins are homologous cyclic molecules containing six or more α-D-glucopyranose units linked together at the 1,4-positions as in amylose. The six-unit cyclodextrin is known as α-cyclodextrin, the seven-unit cyclodextrin is known as β-cyclodextrin and the eight-unit cyclodextrin is known as γ-cyclodextrin.

Being cyclic, the molecule forms a torus. The inclusion compound is formed by the insertion of the included compound in the center of the torus. The center of the cyclodextrin torus is hydrophobic, while the exterior is hydrophilic, explaining the effectiveness of this molecule in solubilizing hydrophobic materials of low water solubility. The inclusion compound forms because of the affinity of the hydrophobic "guest" molecule for the hydrophobic interior of the "host" cyclodextrin, yet the compound remains water soluble because of the hydrophilic exterior of the cyclodextrin.

Cyclodextrins suitable for use with the present invention may be α-, β- or γ-cyclodextrins. Whether an α-, β- or γ-cyclodextrin should be selected for complexing with the organic metal finishing additive to be stabilized can be readily determined by one of ordinary skill in the art without undue experimentation. The objective is the selection of a cyclodextrin having a torus of optimum cavity size to permit penetration of the guest molecule, without penetration of the aqueous solvent. A typical screening of cyclodextrins is illustrated in Yonezawa, *Agric. Biol. Chem.*, 45(2), 505–6 (1981).

The compound to be stabilized is mixed in a common solvent such as water or a water-miscible solvent such as methanol or similar lower alkanols, together with a candidate cyclodextrin and evaluated for the formation of cyclodextrin inclusion compounds. If inclusion compounds do not form, then the cyclodextrin torus cavity size is too small. The inclusion compounds that do form are evaluated for stability in aqueous metal treating solutions, with the selection of the cyclodextrin providing the greatest stability. Depending upon the organic metal finishing additive in question, the stability determination may involve an evaluation of hydrolytic stability, volatility or metal precipitate formation.

Cyclodextrins suitable for use with the present invention include cyclodextrin derivatives. Examples of suitable derivatives include di- and trimethyl cyclodextrins, hydroxyalkyl cyclodextrins, sulfated cyclodextrins, and the like. Particularly useful commercially available cyclodextrins include 2-hydroxypropyl β-cyclodextrin, hydroxy ethyl-β-cyclodextrin, carboxymethyl-β-cyclodextrin, quaternary ammonium-β-cyclodextrin, sulfated-β-cyclodextrin, methyl-β-cyclodextrin and triacetyl-β-cyclodextrin.

The cyclodextrins are then used to form inclusion compounds, which are soluble in aqueous metal treating baths, with organic metal finishing additives. For purposes of the present specification, the term "organic metal finishing additives" refers to organic compounds employed as conventional additives in metal finishing processes. The term "organic" is used in its conventional sense referring to compounds containing carbon other than binary or ternary carbon compounds or metallic carbonates. The term "metal" refers to the use of the additives in metal finishing products, and does not imply that the carbon compound must be organometallic.

The organic metal finishing additives suitable for use with the present invention include essentially any organic compound capable of improving the final result of a metal finishing process, even if the organic additive is not hydrolytically unstable or volatile and does not form insoluble metal precipitates. Formation of a cyclodextrin inclusion compound will improve the water solubility and consequently increase the activity of essentially any organic compound, even those considered to be adequately water-soluble. The increased activity permits less of the additive to be used to obtain the desired effect, thus providing a distinct improvement over conventional additives that are not used in the form of inclusion compounds. Organic metal finishing additives suitable for use with the present invention can be readily identified by those of ordinary skill in the art without undue experimentation.

Preferably, the cyclodextrin inclusion compound is formed with an organic metal finishing additive that is either poorly water soluble, hydrolytically unstable, volatile, or which forms an insoluble metal precipitate. Again, organic compounds suffering from such drawbacks can be readily identified by those of ordinary skill in the art without undue experimentation. Examples of poorly water soluble organic metal finishing additives, the solubility of which can be improved by the formation of cyclodextrin inclusion compounds, include TETD, flavanols, benzylidine acetone, O-chlorbenzaldehyde, naphthaldehyde, benzaldehyde, and the like.

One example of a hydrolytically unstable organic metal finishing additive, the hydrolytic stability of which can be improved by the formation of a cyclodextrin inclusion compound, is glutaraldehyde. Examples of volatile organic metal finishing additives, the volatility of which can be reduced by the formation of cyclodextrin inclusion compounds include acetaldehyde, O-chlorbenzaldehyde, naphthaldehyde, benzaldehyde, and the like.

Whether an organic metal finishing additive forms an insoluble precipitate with a metal in an aqueous metal treating bath typically depends upon the valence of the metal. Thus, the divalent form of metals such as tin form insoluble precipitates with organic metal finishing additives such as flavanols, flavones, tannins, catechins, and the like.

The organic metal finishing additive and the cyclodextrin are dissolved together in a common solvent such as water or a water-miscible solvent such as methanol or similar lower alkanols to form the inclusion compound. While the molar ratio of cyclodextrin to organic metal finishing additive is not critical, the stabilizing effect of the cyclodextrin increases as the molar ratio of the cyclodextrin to the organic compound increases. The combination of the cyclodextrin and the organic compound to form the inclusion compound is an equilibrium reaction; therefore, an excess of cyclodextrin over the organic compound is desirable to ensure that no free organic compound remains in solution. Therefore, a molar ratio of cyclodextrin to organic compound greater than about 1:1 is preferred, and a molar ratio over about 2:1 is even more preferred.

The techniques associated with the preparation of cyclodextrin inclusion compound solutions in accordance with the present invention are well known and may vary somewhat depending upon the specific organic metal finishing additive and cyclodextrin, without departing from the essential parameters relating to dissolving an organic metal finishing additive and a cyclodextrin in a common solvent to form an inclusion compound. Specific details are provided for purposes of illustration and to provide a best mode for the practice of the invention, and therefore the invention should not be limited to those parameters.

The cyclodextrin inclusion compounds of the present invention may be prepared by first dissolving the cyclodextrin in the common solvent, before adding the organic metal finishing additive, if the additive, were it added first, prior to the addition of the cyclodextrin, would be unstable in the common solvent alone.

The cyclodextrin solution may be prepared by dissolving a predetermined quantity of cyclodextrin in the common solvent, with stirring at room temperature for at least 30 minutes, and preferably for at least an hour. The mixture may be heated to promote solution formation.

A predetermined quantity of the organic metal finishing additive may then be added with stirring. Again, the mixture may be maintained at room temperature and stirred for at least half an hour, and preferably for at least an hour. This mixture may also be heated to temperatures up to 70°–73° C. to promote formation of the inclusion compound.

The resulting cyclodextrin inclusion compound of the organic metal finishing additive may then be directly added to aqueous metal treating baths. The amount to be utilized should be based on the molar equivalent quantity of the organic metal finishing additive contained in the cyclodextrin inclusion compound. Thus, two grams of an organic metal finishing additive complexed with cyclodextrin in 1 L of water will produce an aqueous solution containing 2 g/L of the organic metal finishing additive as the cyclodextrin complex. The total quantity of solution to be added to the metal treating bath will then depend on the quantity of organic metal finishing additive necessary to attain the desired bath concentration.

The cyclodextrin inclusion compound may be added to aqueous metal treating baths to provide organic metal finishing additive levels equivalent to those conventionally used to for the additive in question. However, the present invention makes it possible to use the organic metal finishing additive at below-conventional levels and still obtain the desired metal finishing result. The lower levels at which the organic metal finishing additive may be utilized in the form of cyclodextrin inclusion compound may be readily determined by those of ordinary skill in the art without undue experimentation, and merely involves repeating the metal treating process on fresh workpieces with successively lower levels of additive until the lowest additive level at which a desirable result is obtained is identified.

The cyclodextrin inclusion compounds of organic metal finishing additives may otherwise be directly substituted for the non-complexed organic metal finishing additive in conventional aqueous metal treating baths without further modifying the bath. Metal treating processes for which the present invention is particularly well suited include electroplating, which is widely used to coat objects with thin layers of metal through electrolytic deposition, and electroless plating, which applies protective coatings of copper, cobalt, nickel, gold or palladium in a bath by chemical reduction without application of an electric current. The cyclodextrin inclusion compounds of the present invention may be utilized with both acidic and basic metal treatment baths. Other aqueous metal treating processes suitable for use with the present invention include cleaning, pickling and etching processes, and the like.

Examples of aqueous electroplating baths to which cyclodextrin inclusion compounds of organic metal finishing additives may be added include bright acid copper plating bath, divalent acid tin baths, copper pyrophosphate plating baths, acid copper sulfate plating baths, acid zinc plating baths, alkaline zinc plating baths, acid chloride zinc plating baths, acid tin plating baths, tin-zinc alloy plating baths, tin-nickel alloy plating baths, tin-copper alloy plating baths, tin-lead alloy plating baths, nickel plating baths, and the like. The cyclodextrin inclusion compound is typically included at levels equivalent to up to about 500 ppm of the organic metal finishing additive. Conventional aqueous electroplating baths also include components such as one or more metal salts, one or more conductive metal solubilizing agents, and one or more additives responsible for the quality of the resulting deposit.

Examples of aqueous electroless plating baths to which cyclodextrin inclusion compounds of organic metal finishing additives may be added include copper plating baths, tin plating baths, nickel plating baths, and the like. The cyclodextrin inclusion compound is typically added at levels equivalent to up to about 500 ppm of the organic metal finishing additive. Conventional aqueous electroless plating baths also include components such as one or more metal salts, one or more complexing agents, one or more reducing agents, one or more bath stabilizers and one or more additives responsible for the quality of the resulting deposit.

The present invention thus satisfies a heretofore unmet need for a method by which organic metal finishing additives may be stabilized in aqueous metal treating baths, so that the amount of the organic metal finishing additive added to the metal treating bath may be significantly reduced while still obtaining the desired result. This significantly reduces the cost of metal finishing processes.

The following examples illustrate particular conditions, steps and materials within the scope of this invention, it being understood that these examples are given only by way of illustration and not limitation.

EXAMPLES

EXAMPLE 1

As mentioned above, in acid copper plating solutions, copper deposits with improved brightness are obtained by adding small quantities of TETD to conventional bright acid copper plating baths. Because TETD is insoluble in water, it must first be dissolved in a water-miscible solvent such as methanol and then added to the plating bath, in the case of methanol, as an alcoholic solution. As noted above, once added to the bath, the TETD does not remain in solution long, and its beneficial effect is quickly lost because it precipitates out in a short time.

A cyclodextrin inclusion compound of TETD was prepared by first adding 0.5 g TETD to a sufficient amount of methanol (about 50 mL) to ensure complete solubility at 120° F.–140° F. To this mixture was added 3.8 g of β-cyclodextrin (American Maize Products Company, Hammond, Indiana), after which the reaction mixture was heated to 150° F. 300 mL water was added to the mixture with stirring and with continued heating at 150° F. The methanol was evaporated and its volume was replaced with water while the reaction mixture was maintained at 150° F. As the reaction mixture became transparent, water was slowly added to increase the total volume to 1 L, while maintaining the temperature between 120° F. and 140° F. The 120° F.–140° F. temperature was maintained with continuous stirring for 30 minutes, after which the reaction mixture was cooled to ambient temperature.

A plating test was then performed using an acid copper bath with the following composition:

| | |
|---|---|
| copper sulfate hydrate | 240 g/L |
| sulfuric acid | 60 mL/L |
| chloride ion | 75 ppm |
| Carbowax 14000 | 400 ppm |
| Bis-(3-sulfopropyl)-disulfide-disodium salt | 17 ppm |
| cyclodextrin TETD | 0.75 ppm (based on TETD) |

Plating was performed on a polished brass panel using a Hull cell at room temperature for 10 minutes at 2 amperes. The deposit was brilliant and beautifully leveled. A control panel was plated using the same solution but substituting TETD dissolved in methanol instead of the cyclodextrin-TETD inclusion product. The resultant panel was equally bright and leveled.

Both solutions were permitted to stand 24 hours at room temperature after which Hull cell panels were again run. The solution containing the TETD-cyclodextrin showed only a minor loss of activity, while the other one containing the TETD-methanol suffered a complete (100%) loss of activity.

EXAMPLE 2

As noted above, flavanols are useful metal finishing additives for divalent acid tin plating baths, but have a short life in the acid tin bath because they form insoluble complexes with the divalent tin that precipitate out of the solution. Flavanols also have only limited solubility in the acid tin bath, resulting in a very low bath concentration. The poor solubility in combination with the tendency to precipitate with tin severely limits the use of flavanols in acid tin plating baths.

An inclusion compound of cyclodextrin with morin, a typical flavanol, was prepared by first heating two liters of 4 mL $NH_4OH$/L to about 120° F.–140° F. 37.85 g morin was added to this solution with continuous stirring for 20–30 minutes. 141.78 g β-cyclodextrin was then added to the reaction mixture with continuous stirring for an additional 20–30 minutes while maintaining the temperature between 120° F. and 140° F. Water was then added to bring the reaction mixture to 3.785 L while maintaining the temperature between 120° F. and 140° F. Stirring was continued within this temperature range until the solution became completely transparent.

The resulting solution contained 10 g/L morin complexed with cyclodextrin. This solution was then compared with a 10 g/L methanol solution of morin. When the methanol solution was added to an acid tin plating solution, a significant spontaneous precipitation took place, whereas the morin-cyclodextrin aqueous solution added to a similar acid tin solution showed no precipitation.

EXAMPLE 3

Another useful metal finishing additive for divalent acid tin baths having very limited solubility in water is benzylidene acetone. Because of the limited water solubility, the compound must first be dissolved in methanol or some other water-miscible solvent before it can be added to the plating bath. In addition to the inherent shipping and storage problems with flammable solvents, some loss of activity and stability takes place when the solvent-dissolved benzylidene acetone is added to a predominantly aqueous matrix, such as a plating bath.

A cyclodextrin inclusion compound of benzylidene acetone was prepared by adding 10 g of benzylidene acetone to a 1 L reaction vessel equipped with a large reflux condenser. 105.4 g of hydroxypropyl-β-cyclodextrin was then added to the benzylidene acetone in the reaction vessel. The mixture was refluxed at 100° C. until a completely transparent straw yellow solution was obtained. To this solution was added sufficient water to bring the volume to 1 L. The resulting aqueous solution was clear and contained 10 g/l of benzylidene acetone as the cyclodextrin complex. A fraction of the solution was added to a tin plating bath containing the following:

| | |
|---|---|
| tin sulfate | 30 g/L |
| sulfuric acid | 105 mL/L |
| ethoxylated alkylphenol (nonionic) | 6.3 g/L |
| cocoamphodipropionic acid | 1.3 g/L |
| acrylic acid | 38 ppm |
| cyclodextrin-benzylidene acetone | 200 ppm (based on benzylidene acetone) |

A steel panel was plated in a whole cell at 60° F. for five minutes at two amperes. The deposit was brilliant and leveled across the entire current density range.

EXAMPLE 4

As noted above, acetaldehyde is also a desirable compound to be used in a divalent acid tin plating bath, but it is difficult to control the desired concentration of this additive because of its great volatility at ambient and elevated temperatures. An aqueous solution of acetaldehyde with very minimum volatile escape of this additive was prepared by dissolving 450 g of hydroxypropyl-βcyclodextrin in 300 mL of water at temperature between 50° C. and 60° C. in a 2 L reaction vessel equipped with a very efficient reflux condenser. With the condensation temperature maintained between 0° and 6° C., a solution of 80 g/L of acetaldehyde in water was added dropwise over one hour while maintaining the temperature between 50° C. and 60° C. until the volume of the solution in the vessel reached 1 L. The solution was then allowed to cool to room temperature (20° C.) and maintained at this temperature for eight hours with continuous stirring and cooling of the condenser.

The resulting solution contained 56 g/L of acetaldehyde and was stored and handled uncovered for reasonable periods of time without appreciable loss of material from volatility. The solution was furthermore added and maintained at controlled concentrations to divalent acid tin plating baths with a drastic reduction in the loss of acetaldehyde from its volatility, attributable to the acetaldehyde being in the form of a inclusion compound with a cyclodextrin.

The foregoing examples demonstrate the improved solubility and stability of specific organic metal finishing additives when added to aqueous metal treating baths in the form of cyclodextrin inclusion complexes. As will be readily appreciated, numerous variations and combinations of the features set forth above can be utilized without departing from the present invention as set forth in the claims. Such variations are not to be regarded as a departure from the spirit and scope of the invention, and all such modifications are intended to be included within the scope of the following claims.

What is claimed is:

1. A method for stabilizing organic metal finishing additives in aqueous metal plating baths comprising the steps of:

dissolving an organic metal finishing additive with a cyclodextrin in a common solvent therefor, so that an inclusion compound of said organic metal finishing additive in said cyclodextrin is formed, wherein said organic metal finishing additive is selected from the group consisting of water-insoluble organic metal finishing additives, hydrolytically unstable organic metal finishing additives, organic metal finishing additives that form insoluble metal precipitates and volatile organic metal finishing additives; and dissolving said inclusion compound in said aqueous metal plating bath.

2. The method of claim 1, wherein said cyclodextrin is selected from the group consisting α-cyclodextrins, β-cyclodextrins, γ-cyclodextrins and derivatives thereof.

3. The method of claim 2, wherein said cyclodextrin is a β-cyclodextrin.

4. The method of claim 1, wherein said organic metal finishing additive is a water-insoluble compound selected from the group consisting of tetraethylthuramidisulfide, flavanols, benzylidene acetone, O-chlorobenzaldehyde, naphthaldehyde, benzaldehyde, and derivatives thereof.

5. The method of claim 1, wherein said organic metal finishing additive is glutaraldehyde.

6. The method of claim 1, wherein said organic metal finishing additive is a compound that forms insoluble metal precipitates selected from the group consisting of flavanols, tannins and catechins.

7. The method of claim 1, wherein said organic metal finishing additive is a volatile compound selected from the group consisting of acetaldehyde, O-chlorobenzaldehyde, naphthaldehyde and benzaldehyde.

8. The method of claim 1, wherein said common solvent is water.

9. The method of claim 1, wherein said common solvent is a water-miscible solvent.

10. The method of claim 9, wherein said water-miscible solvent is methanol.

11. The method of claim 1, wherein said organic metal finishing additive is dissolved in said common solvent with an excess of said cyclodextrin.

12. The method of claim 11, wherein the molar ratio of said cyclodextrin to said organic metal finishing additive is greater than about 2:1.

13. An aqueous metal plating bath having dissolved therein an inclusion compound of an organic metal finishing additive in a cyclodextrin, wherein said organic metal finishing additive is selected from the group consisting of water-insoluble organic metal finishing additives, hydrolytically unstable organic metal finishing additives, organic metal finishing additives that form insoluble metal precipitates and volatile organic metal finishing additives.

14. The aqueous metal plating bath of claim 13, wherein said cyclodextrin is selected from the group consisting of α-cyclodextrins, β-cyclodextrins and γ-cyclodextrins, and derivatives thereof.

15. The aqueous metal plating bath of claim 14, wherein said cyclodextrin is a β-cyclodextrin.

16. The aqueous metal plating bath of claim 13, wherein said organic metal finishing additive is a water-insoluble compound selected from the group consisting of tetraethylthuramidisulfide, flavanols, benzylidene acetone, O-chlorobenzaldehyde, naphthaldehyde and benzaldehyde.

17. The aqueous metal plating bath of claim 13, wherein said organic metal finishing additive is a glutaraldehyde.

18. The aqueous metal plating bath of claim 13, wherein said organic metal finishing additive is a compound that forms insoluble metal precipitates selected from the group consisting of flavanols, tannins and catechins.

19. The aqueous metal plating bath of claim 13, wherein said organic metal finishing additive is a volatile compound selected from the group consisting of acetaldehyde, O-chlorobenzaldehyde, naphthaldehyde, benzaldehyde, and derivatives thereof.

20. The aqueous metal plating bath claim 13, wherein said bath is an electroplating bath.

21. The aqueous metal plating bath of claim 13, wherein the bath is an electroless plating bath.

* * * * *

UNITED STATES PATENT AND TRADEMARK OFFICE
CERTIFICATE OF CORRECTION

PATENT NO. : 5,492,615

DATED : February 20, 1996

INVENTOR(S) : Houman

It is certified that error appears in the above-identified patent and that said Letters Patent is hereby corrected as shown below:

On the cover page, after "*Attorney, Agent, or Firm*--" "Krumholz & Mentlik Lerner, David, Littenberg" should read --Lerner, David, Littenberg, Krumholz & Mentlik--.

Column 8, line 66, "hydroxypropyl-ßcyclodextrin" should read -- hydroxypropyl-ß-cyclodextrin --.

Column 9, line 46, after "consisting" insert --of--.

Column 9, line 52, "tetraethylthuramidisulfide" should read --tetraethylthiuramidisulfide--.

Column 10, lines 37-38, "tetraethylthuramidisulfide" should read --tetraethylthiuramidisulfide--.

Signed and Sealed this

Third Day of September, 1996

*Attest:*

Bruce Lehman

BRUCE LEHMAN

*Attesting Officer*

*Commissioner of Patents and Trademarks*